United States Patent [19]

Nakahara et al.

[11] 4,321,816

[45] Mar. 30, 1982

[54] METAL TUBE AND APPARATUS AND METHOD FOR MANUFACTURING THE SAME

[75] Inventors: Yoshihiko Nakahara, Abiko; Norihiro Tsujii, Atami; Kenichi Nakanishi, Minami-ashigara; Yuji Sakai, Nakai; Masanori Saigo, Tokyo, all of Japan

[73] Assignees: Kyodo Insatsu Kabushiki Kaisha; Lion Kabushiki Kaisha, both of Japan

[21] Appl. No.: 63,985

[22] Filed: Aug. 6, 1979

[30] Foreign Application Priority Data

Aug. 8, 1978 [JP] Japan ..... 53-96312

[51] Int. Cl.[3] ..... B21C 23/18; B21C 23/20; B21C 25/02

[52] U.S. Cl. ..... 72/267; 72/273; 72/479; 413/53

[58] Field of Search ..... 72/267, 253.1, 273, 72/266, 476, 479, 348; 113/120 A, 120 H, 120 D; 29/1.3; 220/67, 72, 288, DIG. 22, DIG. 7; 113/120 P, 120 Z

[56] References Cited

U.S. PATENT DOCUMENTS

| | | | |
|---|---|---|---|
| 1,216,282 | 2/1917 | Carver et al. | 72/348 X |
| 1,403,460 | 1/1922 | Talty | 113/120 D |
| 1,480,843 | 1/1924 | Singer | 72/267 X |
| 2,080,399 | 5/1937 | Deibel | 72/267 X |
| 2,104,222 | 1/1938 | Decker | 72/267 X |
| 2,112,085 | 3/1938 | Friden | 113/120 D |
| 2,162,776 | 6/1939 | Friden | 72/267 |
| 2,180,628 | 11/1939 | Friden | 72/267 |
| 2,668,345 | 2/1954 | Eckstein | 72/267 |
| 2,979,195 | 4/1961 | Marlin | 72/267 |
| 3,029,507 | 4/1962 | Gaggini | 72/348 X |
| 3,839,890 | 10/1974 | Phlippoteau | 72/267 X |
| 3,972,702 | 8/1976 | McCormick | 113/120 H |
| 4,185,749 | 1/1980 | Vartia | 113/120 H |
| 4,200,051 | 4/1980 | Nakahara et al. | 113/120 D |

FOREIGN PATENT DOCUMENTS

| | | | |
|---|---|---|---|
| 410231 | 4/1947 | Italy | 72/267 |
| 524146 | 7/1940 | United Kingdom | 72/267 |
| 625919 | 7/1949 | United Kingdom | 72/267 |
| 998287 | 7/1965 | United Kingdom | 72/267 |

OTHER PUBLICATIONS

Impact and Cold Extrusion of Metals by Everhart (1964) pp. 47–57, 101–105, 121–125 and 147–153.

"Tool Design Tips for Cold Extrusion" *Machinery, May 1968, pp. 104–110.*

*Primary Examiner*—Lowell A. Larson

*Attorney, Agent, or Firm*—Steinberg & Raskin

[57] ABSTRACT

A thin-walled metal tube includes a tubular nipple section, a shoulder section joined to the nipple section, a tubular barrel section and a border section connecting the shoulder and barrel sections, the barrel section being defined by a wall having a thickness in the range of between about 20 microns and about 70 microns. The border section includes a region which changes in thickness, the wall thickness of the border section being greater than the thickness of the wall defining the barrel section and the thickness changing region having a cross-section having either an arcuate or a tapered region. Apparatus for manufacturing the thin-walled tube includes a punch having a main shank, a punch head and an extruding corner therebetween having the largest diameter of the punch and a die adapted to cooperate with the punch in a single impact extrusion operation, the die having a recess defined by a side surface, a first bottom surface for forming the shoulder section and the border section of the tube and a second bottom surface for forming the nipple section of the tube. An angle is defined between the punch axis and a line tangent to the surface of the punch head at the extruding corner which is in the range of about 130° to about 170°. The punch and die are formed so that upon the punch reaching the end of its stroke wherein it is located within the die recess, the distance between the surface of the punch head and the first bottom surface of the die is greater than the distance between the extruding corner of the punch and the side surface of the die.

5 Claims, 13 Drawing Figures

METAL TUBE AND APPARATUS AND METHOD FOR MANUFACTURING THE SAME

BACKGROUND OF THE INVENTION

This invention relates generally to thin-walled metal tubes and methods and apparatus for manufacturing the same by a single impact extrusion operation.

More particularly, the invention relates to a punch and die apparatus which permits a stable mass production of thin-walled metal tubes, each tube having a barrel wall thickness in the range of about 20 to 70 microns by a single extrusion operation, a method of producing such thin-walled metal tubes having a barrel wall thickness of 20 to 70 microns by a single extrusion operation with the punch and die apparatus, and to a thin-walled metal tube having a barrel wall thickness ranging between about 20 and about 70 microns having a particular physical characteristic in the border section between the barrel section and the shoulder section thereof.

Collapsible tubes having diameters on the order of about 35 millimeters are well known and are in general use as containers for liquors or pastes. Such conventional collapsible tubes generally comprise a thin-walled metal tube having a wall thickness ranging between about 20 and about 70 microns, the metal tube being coated at its inner and/or outer surface with a layer of plastic having a thickness ranging between about 50 and about 500 microns.

Such conventional composite collapsible structures have moderate pressing characteristics, as well as restoration characteristics, and also have good air and vapor-barrier properties thereby avoiding excessive air-back phenomena. Additionally, such conventional composite collapsible tubes are simple to handle during manufacture and transport and have an atractive appearance. All of these features combine to enhance the commercial value of such composite collapsible tubes.

Laminated tubes including metal foil layers are utilized as collapsible tubes and also have the features discussed above at least to some extent.

However, in such laminated tubes, a longitudinally extending side seam is inevitably formed in the tube body during manufacture. Additionally, the shoulder and barrel sections of the laminated tube are usually separately fabricated and then subsequently joined together. Accordingly, it is not uncommon for such tubes to break or tear along the side seam or joint line between the shoulder and barrel sections.

Since the side seam is typically effected by means of a heat seal, only a thermoplastic resin can be utilized as the coating plastic. Further, such laminated tubes cannot be used as containers for material which requires heat sterilization. A further disadvantage is that such laminated tubes usually exhibit an inferior gas-barrier characteristic at its shoulder section.

In order to overcome these disadvantages of laminated tubes, there is a need for a seamless unitary metal tube which has a barrel wall thickness in the range of about 20 to about 70 microns.

A method for manufacturing a unitary metal tube by a single extrusion operation utilizing punch and die apparatus is disclosed in U.S. Pat. No. 2,112,085.

However, in such conventional method of producing metal tubes by single impact extrusion methods, such for example as in the method disclosed in the above-mentioned patent, it is not possible to reduce the thickness of the barrel wall to less than about 75 microns even in the case of tubes having relatively small diameters for various reasons such, for example, as breakage or tearing of the tube, wrinkles being formed therein due to elongation of the metallic material or breakdown of the punch and die apparatus.

Thus, it has heretofore not been possible to produce in a stable fashion on an industrial production scale a unitary metal tube having a barrel wall thickness in the range of between about 20 and 70 microns and which is suitable for all materials.

Various attempts have been made to satisfy the above requirements. One such attempt is disclosed in U.S. patent application Ser. No. 900,969, now U.S. Pat. No. 4,200,051, wherein a method is disclosed including a first step of manufacturing a primary product by an impact extrusion process or, alternatively, by at least one of a deep drawing, necking, burring and junctioning, and a second step of effecting a secondary product by ironing which employs the use of a specific die ring. According to this method, it is possible to produce a thin-walled metal tube having a barrel wall thickness ranging between about 20 and about 70 microns and which has favorable properties and which is manufacturable in a stable fashion in industrial quantities.

However, this method requires more then two separate steps of plastic working and, therefore, is relatively complicated and expensive thereby giving rise to a necessity for a simpler production method.

Additionally, in the manufacture of a composite tube by coating the metal tube with a plastic layer, the plastic layer is undesirably thinned at the border section between the barrel section and the shoulder section due to the flow of the molten plastic thereby resulting in a deterioration of the mechanical strength at the border section. This deterioration in turn results in problems such as exposure of the metal tube due to wear or bending resulting from contact with a hard member, generation of pin holes or breakage in the vicinity of the border section, and/or collapse or deformation of the tube during transportation particularly when the tubes are transported in a vertical posture.

In view of the foregoing, there is an increased demand for a method providing the capability of manufacturing a thin-walled metal tube in an uncomplicated manner while eliminating the above-mentioned problems inherent in prior art manufacturing techniques.

In order to meet this demand, the present invention comprises a device having the capability of producing thin-walled metal tubes having a barrel wall thickness of about 20 to about 70 microns by a single impact extrusion operation. Further, a method of producing such tubes utilizing the apparatus is also disclosed.

SUMMARY OF THE INVENTION

It is therefore and object of the present invention to provide apparatus which is capable of a stable mass production on an industrial scale of thin-walled metal tubes having a barrel wall thickness ranging between about 20 to about 70 microns by a single impact extrusion process.

It is another object of the present invention to provide apparatus for producing thin-walled metal tubes with no longitudinal side seam and a barrel wall thickness of between about 20 and about 70 microns.

It is still another object of the present invention to provide a method of producing thin-walled metal tubes having no side seam and having a barrel wall thickness of about 20 to about 70 microns in a stable fashion at an industrial scale in a single impact extrusion operation.

It is a further object of the present invention to provide a thin-walled metal tube adapted to be coated on its inner and/or outer surface with a plastic layer to form an ideal composite type collapsible tube.

Briefly, in accordance with the present invention, these and other objects are obtained by providing apparatus for manufacturing by a single extruding operation a thin-walled metal tube having a seamless side including a tubular nipple section having an opening, a shoulder section jointed to the nipple portion, a tubular barrel section and a border section connecting the shoulder and tubular barrel sections, wherein the sections form a continuous wall of metallic material and define an interior space for storing contents therein, the wall of the tubular barrel section being seamless in the axial direction thereof and having a wall thickness ranging between about 20 microns and about 70 microns. The apparatus comprises a punch and a cooperating die, the punch including a main shank, a punch head and an extruding corner through which the main shank is connected to the punch head, the extruding corner having the largest diameter of the punch. The die is provided at its central portion with a recess including a side surface, a first bottom surface for forming the shoulder section and the border section of the tube, and a second bottom surface for forming the nipple section of the tube.

An angle $\theta$ defined between the axis of the punch and a line tangent to the punch head surface at the extruding corner and on the point in the cross-section which includes the punch axis falls within the region as follows:

$$130° \leqq \theta \leqq 170°$$

When the punch is positioned at the stroke end which is closest to the die, the distance between the surface of the punch head and the first bottom surface of the die is greater than the distance between the extruding corner of the punch and the side surface of the die.

According to another feature of the invention, a method of manufacturing a thin-walled metal tube having seamless sides which includes a tubular nipple section having an opening, a shoulder section joined to the nipple section, a tubular barrel section and a border section connecting the shoulder section and the tubular barrel section, wherein the sections form a continuous wall of a metallic material and define an interior space for storing contents therein, the wall of the tubular barrel section being seamless in the axial direction thereof and having a wall thickness ranging between 20 and 70 microns is provided.

The method of the present invention comprises mounting a metallic blank material in a recess of a die, the die recess being constituted by a side surface, a first bottom surface for forming the shoulder section and the boarder section of the tube and a second bottom surface for forming the nipple section of the tube; projecting a punch into the recess of the die for forming the tube from the metallic blank material, the punch being constituted by a main shank, a punch head and an extruding corner therebetween, the latter being provided with the largest diameter of the punch. An angle $\theta$ formed between the punch axis and a line tangent to the punch head surface at the extruding corner and on the point in the cross-section which includes the punch axis is provided to be within the range of between about 130° and about 170°; and locating, during the forming operation, the die and the punch such that the distance between the punch head surface and the first bottom surface of the die is greater than the distance between the extending corner of the punch and the side surface of the die.

The present invention further constitutes a thin-walled metal tube comprising a tubular nipple section having an opening, a shoulder section joined to the nipple section, a tubular barrel section and a border section connecting the shoulder section and the barrel section, the sections forming a continuous wall of a metallic material and defining an interior space for storing contents therein. The wall of the tubular barrel section is seamless in the axial direction thereof and has a thickness in the range of between about 20 microns and about 70 microns. The metallic wall at the border section between the shoulder and barrel sections constitutes a portion whose thickness changes in a gradual fashion, the thickness being generally greater than that of the barrel section, the wall, thickness changing portion being so shaped that its cross-section which includes the tube axis has either an arcuate surface or a tapered surface at at least the inside of the border section of the metallic wall.

BRIEF DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DETAILED DESCRIPTION OF THE PREFERRED EMBODIMENTS

Figure 1:
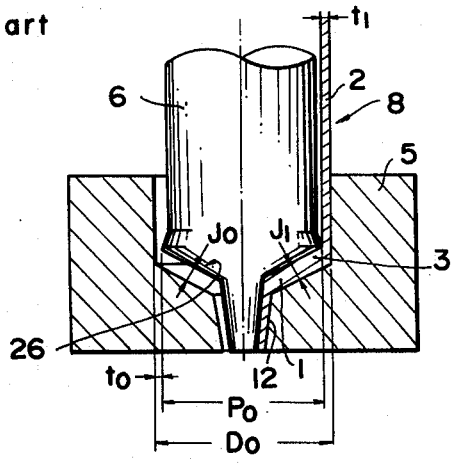
FIG. 1 Prior art
FIG. 1 is a partial sectional view illustrating a single extrusion operation utilizing a conventional prior art punch and die.

Referring now to the drawings wherein like reference characters designate identical or corresponding parts throughout the several views and more particularly to FIG. 1, a schematic illustration of a conventional apparatus for producing a metal tube by impact extrusion is illustrated together with a portion of the product produced. Thus, conventional apparatus including a die 5, a punch 6 and the thin-walled extruded tube 8 are illustrated. The set value of the thickness of the wall of the barrel section of the tube is designated at $t_0$, and has a value obtained by an equation of $t_0=\frac{1}{2}(D_0-P_0)$, where $D_0$ and $P_0$ represent the inside diameter of the die and the diameter of the punch head 26, respectively.

The symbol $J_0$ represents the clearance between the punch head 26 and the die 5 when the punch 6 is located at the end of its stroke, while $J_1$ represents the wall thickness of a shoulder section 1 of the thin-walled extruded tube 8 produced by a single impact extrusion operation utilizing the punch and die 6,5 illustrated in FIG. 1. Further, the wall thickness of a barrel section 2 of the tube 8 is represented by $t_1$.

The thickness of the barrel wall $t_1$ is the mean of the wall thickness $t'$ in the region closer to the border section 3 between the shoulder and the barrel sections 1,2 and the thickness $t''$ at the end portion of tube 8. Thus, the wall thickness $t_1$ of the barrel section is expressed by the following:

$$t_1=(t'+t'')/2.$$

Figure 2:
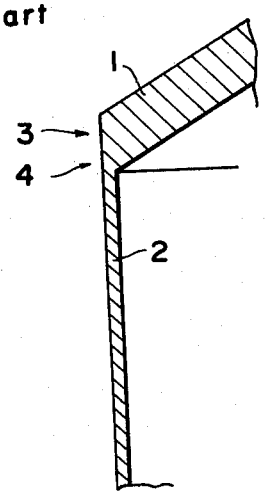
FIG. 2 Prior art
FIG. 2 is a partial sectional view of a conventional metal tube produced by the operation illustrated in FIG. 1.

FIG. 2 illustrates a sectional view of a portion of an extruded metal tube produced by a single impact extrusion operation utilizing the conventional punch and die 6,5 illustrated in FIG. 1. It is apparent that the cross-sectional configuration of the tube wall exhibits a change of an acute angle at the border section 3 between the shoulder section 1 and the barrel section 2.

In order to achieve a stable mass production of such tubes on an industrial scale, the tube conventionally has a wall thickness of between 1.0 and 1.5 mm at its shoulder section 1, and a thickness at the barrel section 2 of between 100 and 130 microns. The thickness of the metal wall at the barrel section 2 can be as large as 75 to 120 microns even in the case of tubes having relatively small diameters, e.g., 12.5 mm or less.

As mentioned above, various problems are experienced in the production of a thin-walled metal tube having a barrel wall thickness which ranges between about 20 and about 70 microns by a single impact extrusion operation utilizing the conventional punch 6 and die 5 as illustrated in FIG. 1. For example, the metal tube is subject to tearing or breakage at the under-shoulder region 4, i.e., at the boundary region between the border section 3 and the barrel section 2 as seen in FIG. 2. Further, wrinkles are likely to be formed in the tube wall by the heat generated during processing due to uneven elongation of the material. Additionally, the metal tube is subject to deformation as it is extracted from the die. Still further, it is extremely difficult to form the metal tube in a precise manner in accordance with the design.

Referring to FIGS. 3–6, punches 6 and dies 5 constructed in accordance with the present invention are illustrated in a somewhat larger scale than FIG. 1. The reference numerals utilized in connection with these figures correspond to analogous elements discussed above. Thus, referring first to FIG. 3, the die 5 is provided at its central portion with a recess 20 having a side surface 21, a bottom surface 22 for forming the shoulder and border sections 1,3 of the tube to be produced, the border section 3 connecting the shoulder section 1 to a barrel section 2 of the tube, and a bottom surface for forming the nipple section 12, (see FIG. 1) of tube 8.

Figure 3:
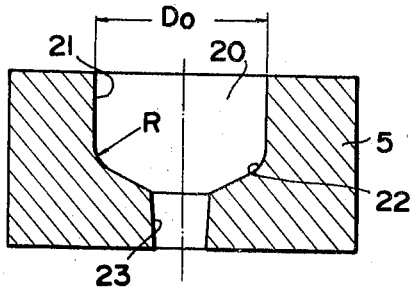
FIG. 3 is a sectional view of a die which constitutes a part of the apparatus of the present invention.

The die 5 illustrated in the embodiment of FIG. 3 is formed so as to provide the outer surface of the border section 3 which connects the barrel and shoulder sections 2,1 of the tube 8 with a rounded outer surface. As illustrated, the bottom surface 22 of the die 5 has a roundness of a radius of about 0.5 to about 3.0 mm and, preferably, of between 1.0 to 2.0 mm.

Figure 4:
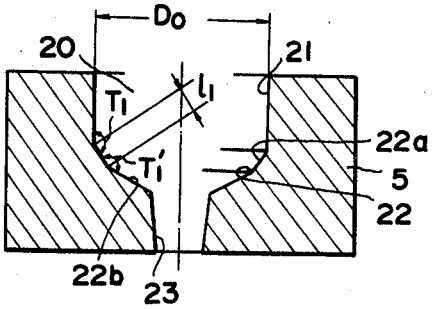
FIG. 4 is a sectional view of a die which constitutes a part of another embodiment of the present invention.

FIG. 4 illustrates another embodiment of the die 5 according to the present invention. In this embodiment, the die 5 is provided at its bottom surface 22 of the die recess 20 with a first tapered portion 22*a* having a length $l_1$ (which constitutes the length of the line which generates the tapered portion) of between about 0.5 to about 5.0 mm and, preferably, between 1.0 and 0.3 mm. This first tapered portion 22*a* is inclined to a second tapered portion or conical surface 22*b* of the bottom surface 22 at an angle $T_1'$ which falls within the range of between about 130° and about 170°, preferably between 150° and 170° and more preferably between 155° and 165°. Further, this tapered surface 22*a* is inclined to the tube axis at an angle $T_1$ which ranges between about 130° and 170°, and preferably between 140° and 160°. As described hereinbelow, a taper is formed at the border section 3 of the tube 8 which is produced by a process which employs the die 5 illustrated in FIG. 4.

Figure 5:
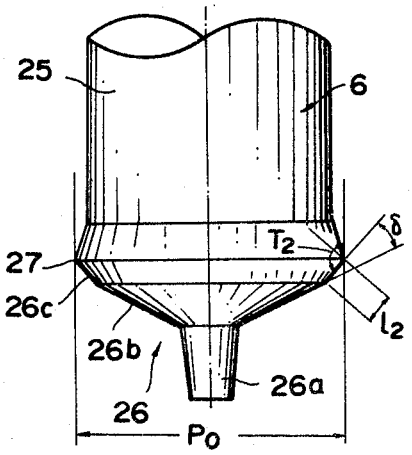
FIG. 5 is a front elevational view of a punch which comprises a part of an embodiment of the present invention.

Referring now to FIG. 5, a punch 6 constructed in accordance with the present invention is illustrated which is used in combination with either of the embodiments of the die 5 illustrated in FIGS. 3 and 4. The punch 6 includes a main shank 25, a punch head 26 and an extruding corner 27 formed between the punch head 26 and the main shank 25. The punch head 26 has a projection 26*a* for forming a nipple section of the tube 8 to be produced, a first head surface 26*b* and a second head surface 26*c*.

The extruding corner 27 has the largest diameter of the punch 6, as is understood in the art. The second head surface 26*c* is formed such that the angle $T_2$ defined between the axis of the punch 6 and a line tangent to the second head surface 26*c*, i.e., the surface of the punch head 26 at the extruding corner 27 in a cross-sectional plane which includes the punch axis, falls within the range of between about 130° and about 170°.

Still referring to the punch 6 illustrated in FIG. 5, the second head surface 26*c* is tapered as illustrated and has a length $l_2$ (the length of the line which generates the second head surface) between about 0.5 and about 5.0 mm and, preferably, between 1.0 and 3.0 mm, and is inclined to the first head surface 26*b* at an angle $\delta$ which ranges between about 5° and about 50°, preferably 10° and 30° and more preferably between 15° and 25°. The angle $T_2$ formed between the axis of the punch 6 and the second head surface 26*c* falls within the range of between about 130° and about 170°, preferably between 140° and 160°.

Figure 6:
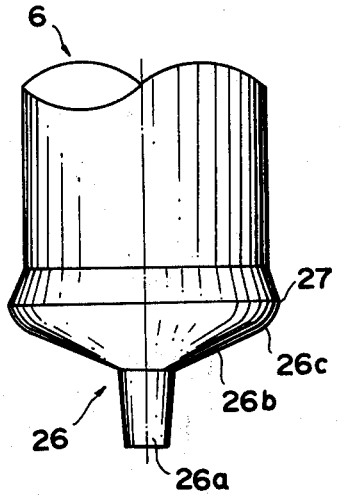
FIG. 6 is a front elevational view of a punch which comprises a part of another embodiment of the present invention.
Figure 6A:
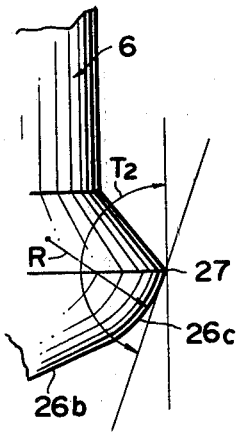
FIG. 6*a* is an enlarged illustration of the punch head of the punch illustrated in FIG. 6.

FIGS. 6 and 6a illustrate another embodiment of the punch 6 constructed in accordance with the present invention and which can be used with either one of the dies illustrated in FIGS. 3 and 4. The punch 6 illustrated in FIGS. 6 and 6a differs from that shown in FIG. 5 in that its second head surface 26c has an arcuate section having a radius which ranges between about 0.5 mm and 3.0 mm, and preferably between 1.0 mm and 2.0 mm.

In any event, in the case of both embodiments of the punch 6, in accordance with the present invention the angle $T_2$ defined between the axis of the punch 6 and a line tangent to the second head surface 26c, i.e., to the surface of the punch head 26 at the extruding corner 27 of the punch 6 at a point in the cross-section which includes the punch axis is selected to fall within the range of between about 130° and about 170°.

The method of producing a thin-walled metal tube 8 having a wall thickness at the barrel section 2 of between about 20 and 70 microns and utilizing the combination of the punch 6 and die 5 illustrated in FIGS. 5 and 4, respectively will now be described.

Figure 7:
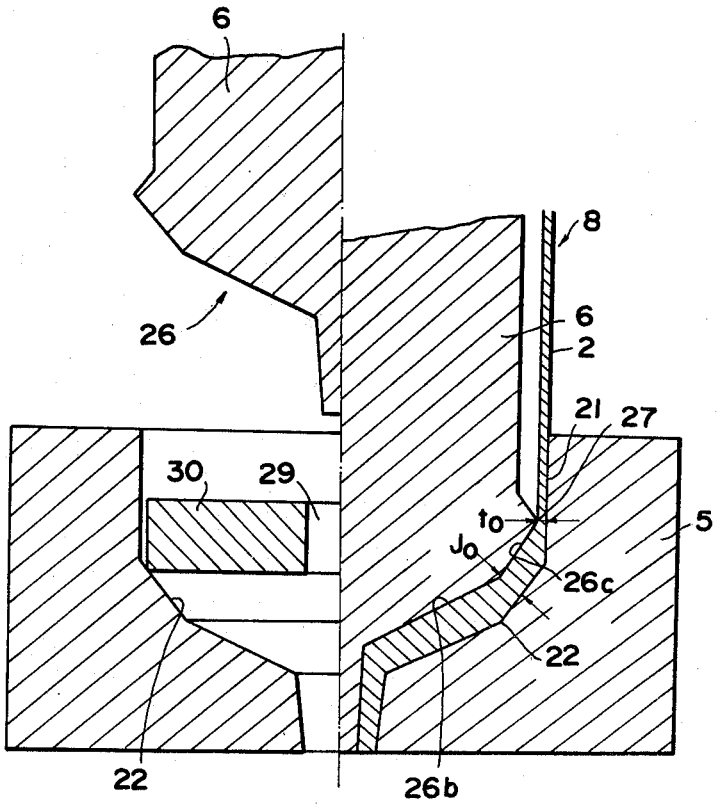
FIG. 7 is a diagrammatical-sectional view illustrating the impact extrusion process for forming a thin-walled metal tube using the punch and die of the present invention, with the left side showing the state before forming and the right side after forming.

Thus, referring to FIG. 7 which illustrates the combination of the die 5 of FIG. 4 and the punch 6 of FIG. 5, a metallic blank 30, known per se, having a central through bore 29 is located on the bottom surface 22 of the die 5.

Subsequently, the punch 6 is projected into the die 5 in which the metallic blank 30 is located and the forming operation is completed within less than a second. The barrel section 2 of the formed tube 8 is extruded parallel to the axis of the punch 6. As seen in FIG. 7, during the forming operation, the die 5 and the punch 6 are always located such that the distance $J_0$ between the surfaces 26b, 26c of the punch head 26 and the bottom surface 22 of the die 5 is greater than the distance $t_0$ between the extruding corner 27 of the punch 6 and the side surface 21 of the die 5.

In other words, the punch 6 and die 5 are appropriately constructed so as to have the structural feature that the distance $J_0$ between the surface 26c of the punch head 26 and the bottom surface 22 of the die 5 is greater than the distance $t_0$ between the extruding corner 27 of the punch 6 and the side surface 21 of the die 5 when the punch 6 is located at the end of its stroke within the recess of die 5.

It is noted that the conventional additional elements normally utilized in connection with impact extrusion apparatus, e.g., means for fixing the die 5 and means for driving the punch 6 at a predetermined stroke, are entirely conventional and well known to those having skill in the art and, for the sake of clarity, are not shown in the figures.

Various materials can be utilized for the metallic blank material 30. For instance, aluminum and aluminum alloys are suitable for use as the metallic blank material 30. In general, metals having a ductility which is high enough to provide a good forming operation, e.g., tin, lead, and the like, can also be used.

The right half portion of FIG. 7 illustrates the thin-walled metal tube 8 having a wall thickness at the barrel section 2 of between about 20 and about 70 microns, formed by the process described above.

Figure 8:
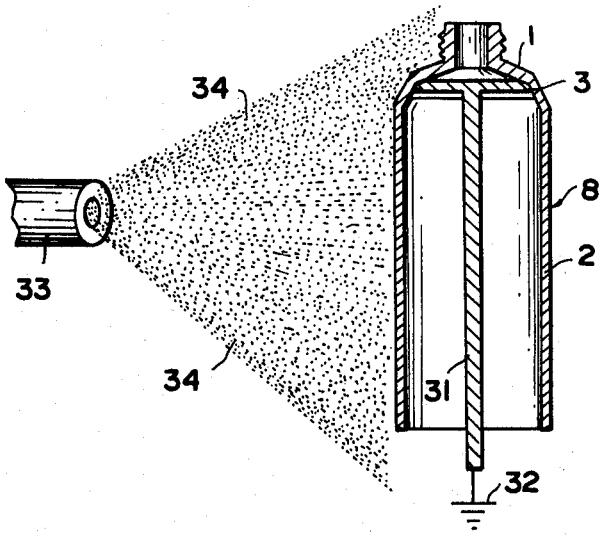
FIG. 8 is a diagrammatical-sectional view illustrating the process of applying a plastic layer onto the thin-walled metal tube according to the present invention.

In order to obtain the final finished product, i.e., the collapsible tube of composite type, a thread for engaging the thread of a cap is formed in the nipple section 12 of the thin-walled metal tube 8 in a conventional manner. Subsequently, an electrostatic powder spray painting is effected on the thin-walled metal tube 8, as shown in FIG. 8. More particularly, plastic particles or powders which are negatively charged, for example to 60 to 90 KV are sprayed and deposited onto the surface of the thin-walled metal tube 8. The discharge rate of the powders is typically 100 to 300 g/min., while the spraying distance preferably 100 to 200 mm. The discharge pressure and the dispersion pressure are 1 to 4 kg/cm$^2$ and 0 to 1.5 kg/cm$^2$, respectively. Subsequent to deposition, the deposited plastic powders are baked at a predetermined temperature to form a coating layer.

This coating layer may be formed on either one or both of the inner and outer surfaces of the thin-walled metal tube 8. In either case, the plastic coating layer has a thickness preferably ranging between 50 microns and 500 microns and, more preferably, between 50 and 350 microns.

Various resins such as polyolefin resin, polyester resin, epoxy resin, polyamide resin and denatured resins of these resins can be used as the plastic for deposition. Among these resins, the polyethelene resin exhibits a superior flexibility and stability against the chemical action of the contents of the tube and, therefore, is most preferred.

In FIG. 8, a jig 31 is provided which grounds the tube schematically illustrated at 32, while an electrostatic spray painting gun 33 deposits the powders or particles of plastic 34 on the tube.

Figure 9:
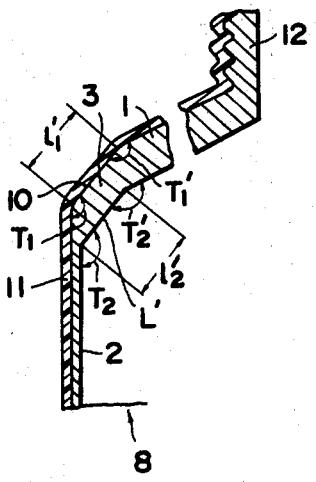
FIG. 9 is an enlarged sectional view of a thin-walled metal tube in accordance with the present invention, showing particularly the shoulder portion thereof.
Figure 10:
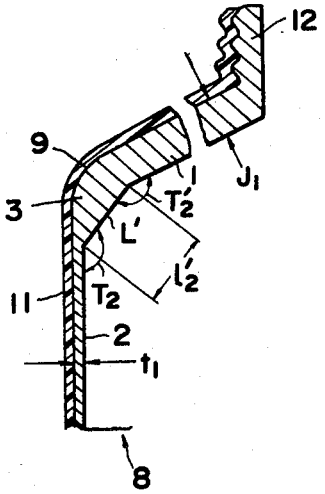
FIG. 10 is an enlarged sectional view of a thin-walled metal tube constituting another embodiment of the invention, illustrating particularly the shoulder portion thereof.

Referring to FIGS. 9 and 10, two composite type collapsible tubes produced according to the method of the present invention are illustrated. More particularly, FIG. 9 illustrates a composite type collapsible tube produced by the method described above, i.e., utilizing the punch 6 and die 5 of FIGS. 5 and 4, while FIG. 10 illustrates a composite type collapsible tube produced by a method utilizing the die 5 and punch 6 shown in FIGS. 3 and 5, respectively.

The wall thickness of the barrel section 2 ($t_1$) of these tubes 8 was 20 microns to 70 microns and the thickness at the shoulder section 1 ($J_1$) was about 400 microns to 1000 microns. Further, a region whose thickness changes was formed at the border section 3 between the shoulder section 1 and the barrel section 2 which generally has a wall thickness which is greater than that of the barrel section 2. More particularly, in the case of the tube illustrated in FIG. 10, the outer surface of the border section 3 is rounded so as to have a radius of about 0.5 to about 3.0 mm. Further, in the case of the tube shown in FIG. 9, the outer surface of the border section 3 has a tapered region 10 having a length $l_1'$ of about 0.5 to about 5.0 mm. The angle $T_1$ formed between the tapered region 10 and the barrel section 2, as well as the angle $T_1'$ formed between the tapered region 10 and the shoulder section 1 falls within the range of between about 130° and 170°.

In the case of each of the tube 8 illustrated in FIGS. 9 and 10, the inner surface of the border region 3 includes a tapered region L' having a length $l_2'$ of 0.5 to 5.0 mm. The angle $T_2'$ of the taper with respect to the inner surface of the shoulder section 1 is about 130° to 175°, while the angle $T_2$ formed between the tapered region L' and the barrel section 2, the latter being parallel to the axis of the tube 8 was about 130° to about 170°, preferably 140° to 160°.

A plastic layer 11 is formed over the entire area of the outer surface of the metal tubes 8 illustrated in FIGS. 9 and 10 in a unitary manner as described above in connection with FIG. 8.

As described hereinabove, at least one of the inner and outer surfaces of the border section 3 is rounded or tapered in connection with the manufacture of the thin-walled metal tube 8 by the punch 6 and die 5 according to the invention.

A considerable difference exists between the taper and roundness with respect to the ease of fabrication of die and punch, particularly in the formability thereof in view of the thinning of the barrel section 2.

Further, the properties of the finished tube will differ depending upon whether the roundness or taper is formed on the inner surface or the outer surface of the boarder section 3.

These differences are quite important and are critical factors which are to be taken into account during tube fabrication.

If it is assumed that at least the inner surface of the boarder section 3 of tube 8 is tapered or rounded, there are then six combinations of possible shapes of the inner and outer surfaces of the boarder section 3. These combinations can be represented as follows: (1) T—T, (2) R—R, (3) X—T, (4) T—R, (5) R—R and (6) X—R, where R designates a rounding condition, T represents a tapering condition and X represents no processing. The first or left symbol in each of the combinations (1) to (6) corresponds to the outer surface of the border section 3 while the second or right symbol corresponds to the inner surface thereof.

In comparing the desirability of roundness and taper formed on the punch and the die, the taper is preferred to the roundness with respect to ease of fabrication of the punch and die and their formability in view of the fitting of the barrel section. More particularly, it has been shown that surprisingly good results are obtained when the punch and the die are provided with taper.

From this point of view, the combination (1) T—T, i.e., the provision whereby tapers are provided on both the inner and outer surfaces of the border section of the tube is most preferred. This combination permits a smooth or gradual thinning of the barrel section while avoiding the generation of wrinkles, recessing, breakage, uneven elongation and other defects during the forming operation. It has been confirmed that through the use of the combination T—T, it is possible to form gentle tapers at the inner and outer surfaces of the border section of the thin-walled metal tube which, in turn, insures a uniform plastic coating layer formed on the tube.

The combinations (2) R—T and (3) X—T are preferred next to the combination (1) T—T. Combinations (4) T—R, (5) R—R and (6) X—R are next preferred to the combinations (2) and (3).

In the case of the combination (5) R—R, an uneven elongation is likely to result during the forming operation when the radius of the roundness on the inner surface is equal to or greater than that of the roundness on the outer surface. Therefore, when the forming operation is conducted with the combination R—R, it is preferred to select the radius of the inner roundness, i.e., the radius of the punch head to be smaller than the radius of the outer roundness, i.e., the radius of roundness of the die.

On the other hand, in the case of the combination (4) T—R, the formability is further improved to assure a better result when the length of the tapered region is selected to be equal to or smaller than the length of the roundness of the inner surface.

It is remarkable and significant that in the thin-walled metal tube constructed according to the present invention, a thickness changing region in which the wall thickness gradually changes is formed as a result of the formation of the roundness or taper in the border section connecting the shoulder section and the barrel section. Additionally, the roundness or the taper permits a uniform coating of the outer surface of the boarder section with the plastic. Consequently, the outer surface of the border section is completely and uniformly coated with a plastic layer of a suitable thickness. Due to this uniform plastic coating layer, the undesirable exposure of the metal tube due to wear of the coating layer during transportation and handling is avoided as is breakage and deformation. Additionally, due to the increased strength at the border section, the undesirable collapsing of the tube at the shoulder section is prevented thereby permitting a vertical stacking in transportation of the metal collapsible tubes which, as noted above, had been difficult with conventional tubes. This feature significantly contributes to the reduction of the cost of transportation.

As noted hereinabove, according to the present invention, the process of manufacturing metal tubes is significantly shortened and simplified to facilitate the control of the process and to reduce the frequency of production of unacceptable products. Further, the number of skilled laborers required is decreased and the installation costs are reduced.

Examples of tubes constructed in accordance with the present invention are summarized in the following tables:

EXAMPLE 1

(35 $\phi$ tube)

| No. | Die (outer surface of shoulder section) | Punch head (inner surface of shoulder section) | Clearance to $\mu$ | Thickness $t_1$ $\mu$ (under-shoulder to tail end portion) | Mean of $t_1$ $\mu$ | Thickness of plastic $\mu$ | Thickness at shoulder section $\mu$ |
|---|---|---|---|---|---|---|---|
| 1 | $T_1' = 160°$<br>$T_1 = 140°$<br>$l_1 = 2.5$ mm | $\delta = 20°$<br>$T_2 = 140°$<br>$L_2 = 2$mm | 20 | 26–34 | 30 | 200 | 800 |
| 2 | $T_1' = 160°$<br>$T_1 = 140°$<br>$l_1 = 2.5$mm | $\delta = 20°$ C.<br>$T_2 = 140°$<br>$l_2 = 2$mm | " | " | " | 350 | " |
| 3. | $T_1' = 160°$<br>$T_1 = 140°$<br>$l_1 = 2.5$mm | $\delta = 20°$<br>$T_2 = 140°$<br>$l_2 = 2$mm | 27 | 32–39 | 36 | 200 | " |
| 4 | $T_1' = 160°$<br>$T_1 = 140°$ | $\delta = 20°$<br>$T_2 = 140°$ | " | " | " | 300 | " |

-continued

| No. | Die (outer surface of shoulder section) | Punch head (inner surface of shoulder section) | Clearance to μ | Thickness $t_1$ μ (under-shoulder to tail end portion) | Mean of $t_1$ μ | Thickness of plastic μ | Thickness at shoulder section μ |
|---|---|---|---|---|---|---|---|
| 5 | $l_1$ = 2.5mm $T_1'$ = 160° $T_1$ = 140° | $l_2$ = 2mm δ = 20° $T_2$ = 140° | 40 | 42–49 | 45 | 200 | 800 |
| 6 | $l_1$ = 2.5mm $T_1'$ = 160° $T_1$ = 140° | $l_2$ = 2mm δ= 20° $T_2$ = 140° | " | " | " | 250 | " |
| 7 | $l_1$ = 2.5mm $T_1'$ = 145° $T_1$ = 155° | $l_2$ = 2mm δ = 30° $T_2$ = 150° | 30 | 43–52 | 47 | 200 | 1000 |
| 8 | $l_1$ = 2.5mm $T_1'$ = 145° $T_1$ = 155° | $l_2$ = 2mm δ = 30° $T_2$ = 150° | " | " | " | 250 | " |
| 9 | $l_1$ = 2.5mm R = 2.5mm | $l_2$ = 2mm δ = 20° $T_2$ = 140° | 43.5 | 55–65 | 60 | 150 | 730 |
| 10 | " | $l_2$ = 1.5mm δ = 20° $T_2$= 140° | " | " | " | 250 | " |
| 11 | — | $l_2$ = 1.5mm δ = 20° $T_2$ = 140° | 40 | 51–61 | 55 | 150 | 760 |
| 12 | — | $l_2$ = 2mm δ = 20° $T_2$ = 140° $l_2$ = 2mm | " | " | " | 250 | " |

EXAMPLE 2

Figure 11:
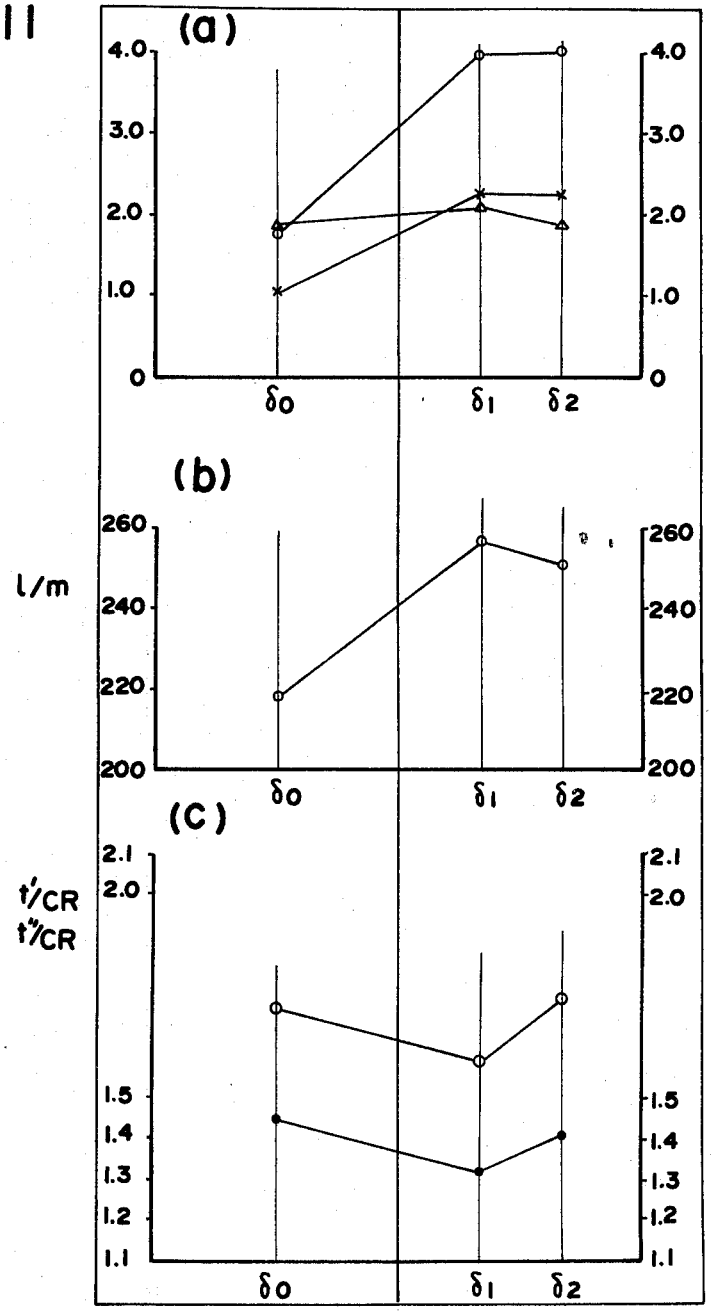
FIG. 11 is a graphic illustration illustrating the advantageous properties of the tube of the present invention relative to the prior art.

FIGS. 11*a*, 11*b* and 11*c* are graphic illustrations depicting the results of tests conducted for the purpose of illustrating how the properties of tubes constructed in accordance with the present invention are varied by the changes in the angle δ (FIG. 5). Each graph charts the mean value obtained from tests of over 100 pieces of samples produced from the same material under the same temperature conditions during processing.

In each graph, the respective properties of the conventional tube is shown at the left half portion of the graph while the properties of the tubes of the present invention are illustrated in the right half portion of the graph.

More specifically, FIG. 11*a* depicts the evaluation of the tubes from the view point of breakage during the formation operation, wrinkling at the tail end portion of the tube and wrinkling at the under-shoulder portion of the tube. The tubes which were tested had a wall thickness $t_0$ at the barrel section in the range of between 50 microns and 70 microns.

Further, the angles $\delta_0$, $\delta_1$, and $\delta_2$ were 0°, 15° to 20° and 25° to 30°, respectively. The evaluation points are on the ordinate axis. The evaluation concerning breakage are indicated by the points designated O. Points 4 and 0 correspond, respectively, to a good product having no breakage and an unacceptable product which has been broken in the course of the forming process.

Similarly, the evaluation concerning the wrinkling at the tail end portion of the tube is designated by an X. Points 3 and 0 correspond, respectively, to a good product having no wrinkles at the tail end portion and to an unacceptable product having wrinkles at the tail end portion. Finally, the designation Δ represents the evaluation of wrinkling at the under-shoulder portion. Points 3 and 0 correspond, respectively, to a good product wherein wrinkles are not present and an unacceptable product which has wrinkles, respectively.

FIG. 11*b* charts the formability, i.e., the plastic-flow characteristics of the tubes. The ordinate axis represent the ration l/m of the barrel length l to the wall thickness m at the shoulder section. The larger the value of this ratio, the greater the ductility and formability become.

FIG. 11*c* charts the structural precision of the product, i.e., the evaluation as to how close the product is finished relative to the desired design shape and size. The ordinate axis represent the ration t'/CR and also the ratio t''/CR, where the symbols t' and t'' represent the final thickness of the barrel, while CR represents the clearance between the die and punch. The value of the ratio t'/CR or T''/CR, when approximating 1, indicates that the tube has been finished having a barrel wall thickness which approximates the desired design value.

From FIGS. 11*a*, 11*b* and 11*c*, it is seen that the best results are obtained when the angle δ has a value intermediate of $\delta_1$ and $\delta_2$, i.e., when the angle δ falls within the region of between 15° and 25°.

EXAMPLE 3

Figure 12:
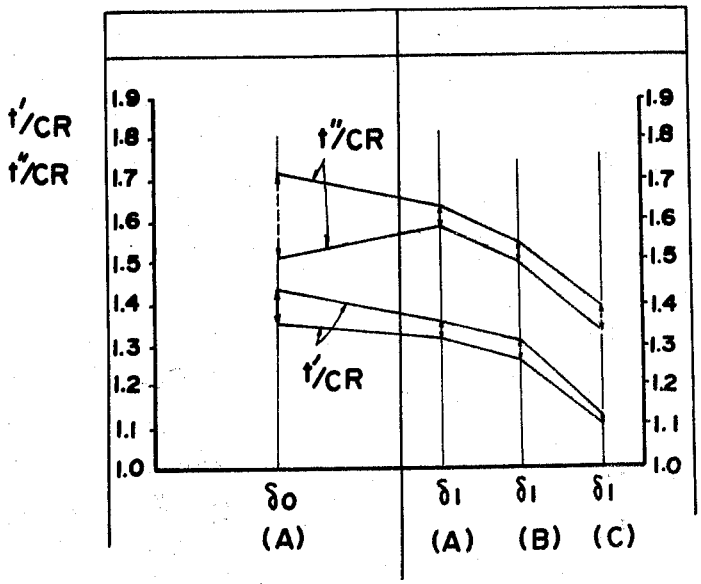
FIG. 12 is another graphic illustration depicting the advantageous properties of the present invention relative to the prior art.

FIG. 12 is a graphic illustration of how the shape of the die affects the precision of the produced tube. More specifically, the data concerning the precision of the prior art tube is shown at the left half part of the Figure while the right half part illustrates the precision of the tube of the present invention.

The abscissa axis of the graph represents the angle δ of the punch head. Angles $\delta_0$ and $\delta_1$ are 0° and 15° to 20°, respectively. As to the die, symbol A represents a conventional die, while symbols B and C represent the dies having a roundness and a taper, respectively. The ordinate axis represents the ratio t'/CR, where t' and CR represent, respectively, the actual wall thickness at the tube portion immediately under the shoulder section and the clearance between the punch and die, as well as the ratio t''/CR where t'' represents the actual wall thickness at the tail end portion of the tube. For each ratio, the two curves show the upper and lower limits of the fluctuation. From this figure, it is apparent that the punch of the invention having a head angle $\delta_1$ provides a more precise finish for the tube then the conventional punch which has a head angle of $\delta_0$, provided that the same die A is utilized. It will also be seen that in the case where the punch head angle $\delta_1$ is constant, the die having a taper provides a higher precision and better finishing, as well as better work stability with reduced fluctuation, then the die having a roundness.

Obviously, numerous modifications and variations of the present invention are possible in the light of the above teachings. Accordingly, it is understood that within the scope of the appended claims, the invention may be practiced otherwise than as specifically described herein.

What is claimed is:

1. Single impact extrusion apparatus for manufacturing a thin-walled metal tube having seamless sides including a tubular nipple section having an opening, a shoulder section joined to said nipple section, a tubular barrel section and a border section connecting said shoulder section and said tubular barrel section, wherein said sections form a continuous wall of a metallic material and define an interior space for storing contents therein, said tubular barrel section being defined by a wall which is seamless in the axial direction thereof and having a wall thickness ranging between about 20 microns and about 70 microns, comprising:

a punch including a main shank having a longitudinally extending central punch axis, a punch head and an extruding corner formed between said main shank and said punch head, said punch head having a first head surface and a second head surface and wherein said second head surface of said punch head at said extruding corner has a tapered form in a cross section including said punch axis thereby forming a tapered surface which is inclined with respect to the axis of said punch in the range of between 140° and 160°, said extruding corner having the largest diameter of said punch;

a die provided with a recess or cavity having a side surface, said die being arranged to receive said punch in the cavity thereof in single impact extrusion apparatus, and wherein a clearance is provided between said side surface and said extruding corner such that a wall thickness of between about 20 microns and about 70 microns is obtained, said die having a first bottom surface for forming said shoulder section and said border section of said tube, said first bottom surface including a first tapered portion which is inclined with respect to said punch axis at an angle in the range of between 140° and 160° for forming said border section and a second tapered portion for forming said shoulder section, and a second bottom surface for forming said nipple section of said tube;

and wherein upon the punch reaching the end of its stroke wherein it is located within the die recess, the distance between said first and second head surfaces of said punch head and said first bottom surface of said die is greater than the distance between said extruding corner of said punch and said side surface of said die.

2. Apparatus as recited in claim 1, wherein the length of the line which generates the tapered second head surface is within the range of between about 0.5 mm and about 5 mm.

3. Apparatus as recited in claim 2, wherein the length of the line which generates the tapered second head surface is within the range of between about 1 mm and about 3 mm.

4. Apparatus as recited in claim 1, wherein the length of the line which generates said first tapered portion is within the range of between about 0.5 mm and about 5 mm.

5. Apparatus as recited in claim 4, wherein the length of the line which generates said first tapered portion is within the range of between about 1 mm and about 3 mm.

* * * * *